US009486665B2

(12) United States Patent
Ho et al.

(10) Patent No.: US 9,486,665 B2
(45) Date of Patent: Nov. 8, 2016

(54) ROCKING ROLLER EXERCISER

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 49 days.

(21) Appl. No.: 14/633,021

(22) Filed: Feb. 26, 2015

(65) Prior Publication Data

US 2016/0250513 A1 Sep. 1, 2016

(51) Int. Cl.

| | |
|---|---|
| ***A63B 21/045*** | (2006.01) |
| ***A63B 21/00*** | (2006.01) |
| ***A63B 22/20*** | (2006.01) |
| ***A63B 23/00*** | (2006.01) |
| ***A63B 23/02*** | (2006.01) |
| ***A63B 23/04*** | (2006.01) |

(52) U.S. Cl.

CPC ..... *A63B 21/4045* (2015.10); *A63B 21/0004* (2013.01); *A63B 21/045* (2013.01); *A63B 21/4033* (2015.10); *A63B 22/20* (2013.01); *A63B 23/00* (2013.01); *A63B 23/02* (2013.01); *A63B 23/04* (2013.01); *A63B 2023/003* (2013.01); *A63B 2210/00* (2013.01)

(58) Field of Classification Search

CPC ..... A63B 21/0026; A63B 21/045; A63B 21/0455; A63B 21/4034; A63B 21/4045; A63B 21/4047; A63B 21/4049; A63B 22/04; A63B 22/16; A63B 22/20; A63B 22/201; A63B 22/203

See application file for complete search history.

(56) References Cited

U.S. PATENT DOCUMENTS

| | | | | |
|---|---|---|---|---|
| 5,906,561 | A | 5/1999 | Lin | |
| 6,709,367 | B1 | 3/2004 | Liang | |
| 7,137,928 | B1 | 11/2006 | Chen | |
| 7,841,971 | B2 * | 11/2010 | Smith | A63B 21/06 473/229 |
| 2005/0209058 | A1 | 9/2005 | Yu | |
| 2007/0232458 | A1 | 10/2007 | Liao | |
| 2008/0287263 | A1 | 11/2008 | Cheng | |
| 2013/0045838 | A1 | 2/2013 | Ho | |
| 2014/0162860 | A1 * | 6/2014 | Yang | A63B 69/04 482/146 |

* cited by examiner

*Primary Examiner* — Loan H Thanh
*Assistant Examiner* — Gregory Winter
(74) *Attorney, Agent, or Firm* — Blakely, Sokoloff, Taylor & Zafman LLP

(57) ABSTRACT

An exercise machine including a rocker frame movably coupled with a roller assembly via a torsion resistance mechanism is described. The rocker frame may include at least one arcuate rail to provide floor support for a rocking motion of the rocker frame. One or more pedal control structures may be pivotally coupled with the rocker frame near each distal end of the arcuate rail to drive the rocking motion. The roller assembly may be configured to make a rolling motion when the rocker frame rocks. A torque force can be generated via the torsion resistance mechanism as a result of changes in relative positions between the rocker frame rocking and the roller assembly rolling. The force driving the rocking motion can be countered by the torque force to support exercising movements of a user exerting the force.

11 Claims, 5 Drawing Sheets

ROCKING ROLLER EXERCISER

FIELD OF INVENTION

The present invention relates generally to physical training machines, and in particular, exercise machines structured to facilitate rocking type of movements for exercising torso and leg muscles.

BACKGROUND

With the growing awareness of health problems caused by lack of exercise, the popularity of exercise machines has steadily increased. Typically, these machines are designed for movements of specific parts of the body. For example, stepping exercisers may be used to strengthen leg muscles. Existing stepping machines are usually based on springs or other expensive supporting components. Further, these components may require complicated manufacturing processes.

There is a continuing need for improvements on traditional exercise machines, such as stepping machines, which are not structured economically to facilitate effective exercising movements.

SUMMARY OF THE DESCRIPTION

A rocker and a roller may be configured together via a torsion resistance mechanism to provide a space saving exercising device for supporting rocking/stepping type of exercising movements.

In one embodiment, an exercise machine can include a rocker frame movably coupled with a roller assembly via a torsion resistance mechanism. The roller assembly may be confined to a rolling motion on a floor via a rocking motion of the rocker frame. The rocker frame may include at least one arcuate rail to provide floor support for a rocking motion along a direction between two distal ends of the arcuate rail on a floor. One or more pedal control structures may be pivotally coupled with the rocker frame near each distal end of the arcuate rail to drive the rocking motion. In one embodiment, a torque force may be generated via the torsion resistance mechanism as a result of changes in relative positions between the rocker frame and the roller assembly. The force driving the rocking motion can be countered by the torque force to support exercising movements of a user exerting the force.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further, specific numeric references such as first, second, third, etc., may be made. However, the specific numeric references should not be interpreted as a literal sequential order but rather interpreted as references to different objects. Thus, the specific details set forth herein are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
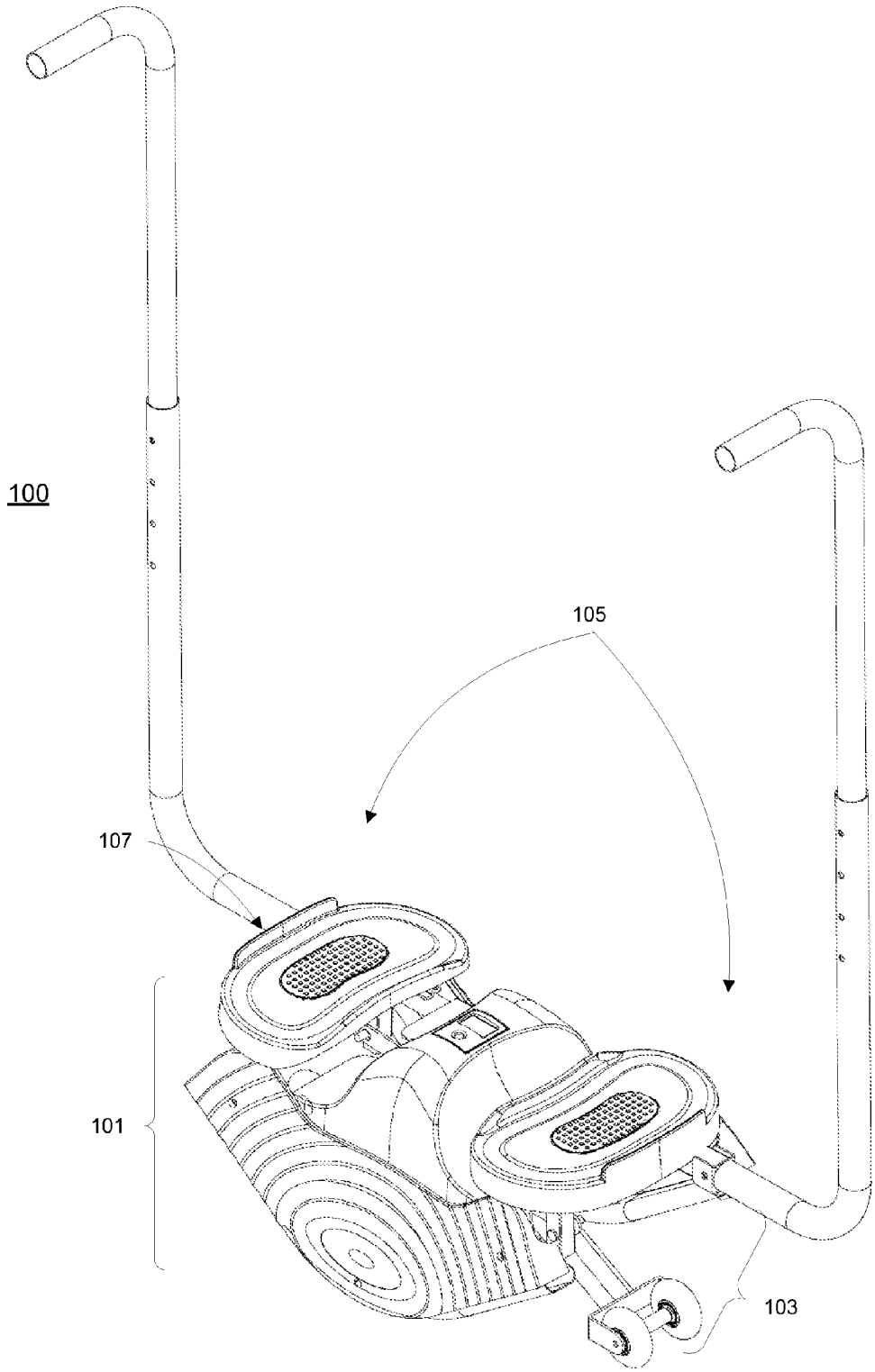
FIG. 1 is a perspective view of an embodiment of an exercise machine.

FIG. 1 shows a perspective view of an embodiment of an exercise machine. Exercising machine or device 100 can include rocker frame 101 movably or rotably coupled with roller assembly 103 via a torsion resistance mechanism (not shown). A pair of pedal control structures 105 may be pivotaly attached with rocker frame 101. Foot pedals 107 can allow a user to drive rocking motions of rocker frame 101 via alternating left/right stepping motions on foot pedals 107. Roller assembly 103 can be induced and confined to rolling motions when rocker frame 101 rocks (e.g. between left and right sides).

In one embodiment, exercising device 100 may be configured in a neutral position when no force is exercised on pedal control structures 105 (e.g. with rocker frame 101 and roller assembly 103 staying still without movements). Resistance force may be generated as rocker frame 101 rocks (e.g. to the left or to the right) to move roller assembly 103. The resistance force may counter the movement of roller assembly 103 induced by rocker frame 101. In other words, the rocking motion and rolling motion can cause the resistance force to balance the exercising force exerted by a user of exercise device 100.

Figure 2:
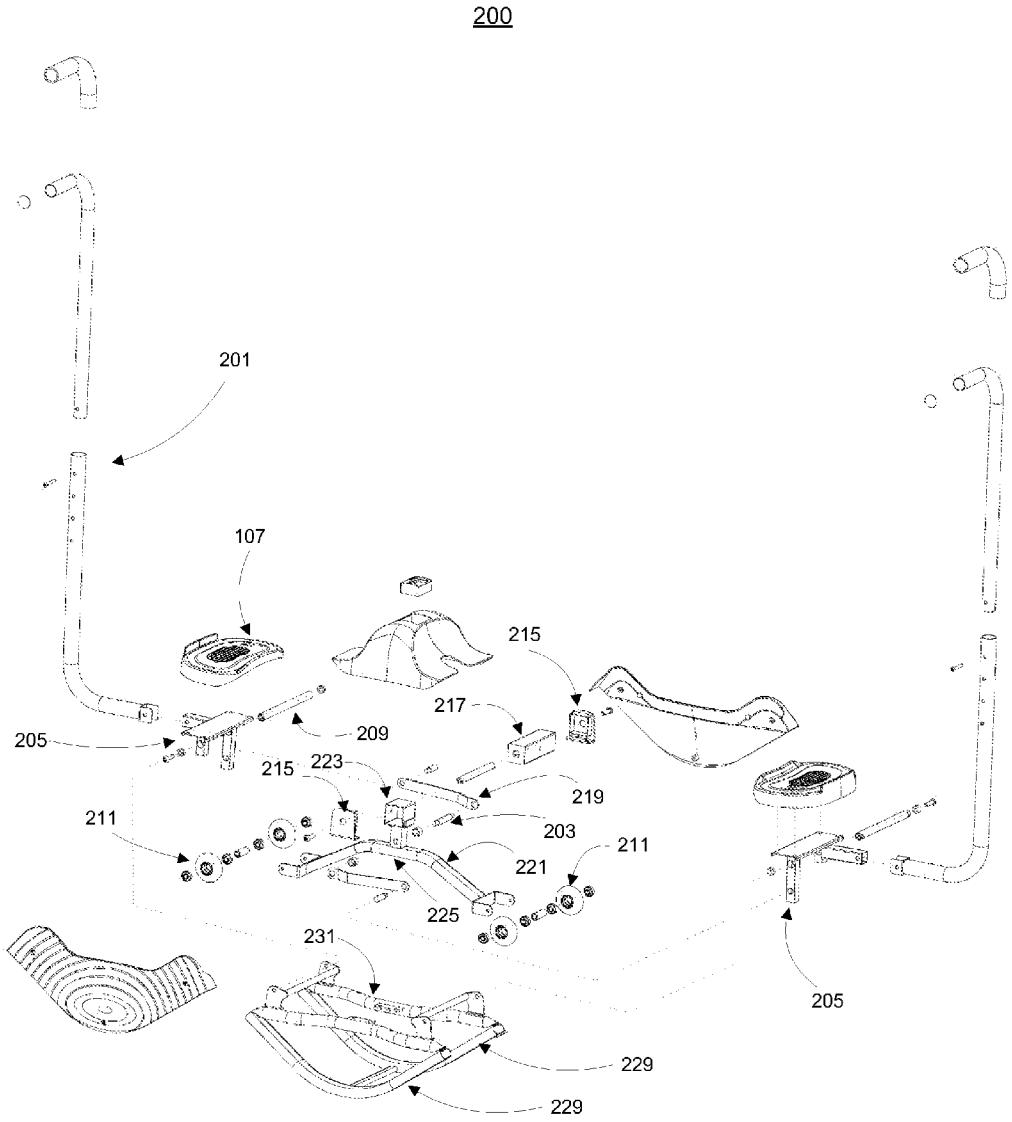
FIG. 2 is an exploded view of an embodiment of an exercise machine.

FIG. 2 illustrates an exploded view of an embodiment of an exercise machine as shown, for example, in FIG. 1. Device 200 may include a rocker frame, such as rocker frame 101 of FIG. 1, having at least one arcuate rail 229 to provide floor support for a rocking motion along a direction between two distal ends of the arcuate rail on a floor. For example, the rocker frame (e.g. rocker frame 101) may include a pair of arcuate rails 229 configured substantially parallel to each other to support a standing or an upright position on the floor. The rocker frame may include bridge members 231 affixed between two distal ends of arcuate rails 227.

A roller assembly, such as roller assembly 103 of FIG. 1, may include leg structure 221 extended substantially parallel longitudinally along arcuate rails 229 of the rocker assembly. For example, leg structure 221 may have two ends extending longitudinally towards two distal ends of the rocker frame. Leg structure 221 may be arranged in between arcuate rails 229 to make use of available vertical space without interferences between the rolling motion of the roller assembly and the rocking motion of the rocking frame. In some embodiments, the roller assembly may include multiple leg structures, for example, arranged with at least one arcuate rail of the rocker frame in between two neighboring leg structures. Other structures may be applicable to allow simultaneous rocking motions of the rocker frame and rolling motions of the roller assembly.

Leg structure 221 may include mid portion 225 between two distal ends thereon and one or more rolling members 211 rotably attached to each end of the leg structure to support the rolling motion of the roller assembly. Rolling member 211 may include a wheel or other rollable or slidable structures. The rocker frame may be rotably or pivotally coupled with mid portion 225 of leg structure 221 via coupling bar 203. In certain embodiments, leg structure 221 may be configured with a pair of legs directed towards two longitudinal distal ends to confine the rolling motion of the roller assembly via the rocker frame.

In one embodiment, a resistance mechanism (or torsion resistance mechanism) may include a resistance force provider, such as torsion bar 217, fixated with the rocker frame and the roller assembly at separate longitudinal positions (or engaging positions). The resistance force provider may be deformed (e.g. twisted) between the engaging positions to generate the torque force.

The resistance mechanism may include torsion bar 217 secured by torsion sleeve 223 and holder structures 215. Torsion sleeve 223 may be affixed to mid portion 225 of leg structure 221 of the roller assembly. Torsion bar 217 may be arranged fittingly through torsion sleeve 225.

In one embodiment, torsion bar 217 may be held fittingly at two distal ends via holder structures 215. Each holder structure 215 can be fixedly attached to bridge members 231 of the rocker frame. Holder structures 215 and torsion sleeve 223 can define separate engaging positions between torsion bar 217 with the rocker frame and the roller assembly. These engaging positions may be configured between two distal ends of torsion bar 217. Alternatively, two engaging positions may be defined at two distal ends of torsion bar 217 via holder structures 215.

In one embodiment, torsion bar 217 may comprise elastic or flexible material capable of force transmission and/or energy storage. For example, torsion bar 217 may be deformed (such as elongated, bent, twisted, stressed, pressed, decreased in diameter, etc.) to generate a torque force or other forces. In some embodiments, torsion bar 217 may be made of tendon material having viscoelastic structures exhibiting both elastic and viscous behavior.

Torsion bar 217 may be affixed between the roller assembly and the rocker frame transversely to generate a torque force or other applicable resistance force as a result of movements between the rocker frame and the roller assembly. For example, Torsion bar 217 may be associated with a torsion constant as a geometrical property of the bar's cross-section. The amount of torque force (or resistance force) generated around the axis of the bar may be related (e.g. substantially proportional linearly) to the angle of twist of the bar. The torsion constant, together with material properties and length can describes the bar's torsional stiffness.

In one embodiment, changes in relative positions between the roller assembly and the rocker frame (as the rocker frame rocks and the roller assembly rolls) can deform torsion bar 217 with a twisting angle to generate or cause a torque force or a resistance force which resists the changes. The torque force may counter a force driving the rocking motion of the rocker frame to support exercising movements of a user exerting the force. The amount of the torque force may be substantially linearly proportional to the size of the twisting angle between the rocker frame and the roller assembly) to effectively facilitate a user's exercising movements.

According to a certain embodiment, the cross section of torsion bar 217 may be shaped angularly to restrict or restrain torsion bar 217 from rotational movement at the engaging positions, such as within torsion sleeve 223 and holder structures 215. For example, the cross section of torsion bar 217 may be shaped in an angular form, such as a rectangle, a square, a diamond, an octagon or other applicable non-smooth shapes.

In one embodiment, a pedal control structure, such as pedal control structure 105 of FIG. 1, may include pedal bracket 205 pivotably coupled with the rocker frame near two distal ends of bridge members 231. Coupling arm 219 may be rotably attached between pedal bracket 205 and coupling bar 203 to facilitate driving the rocking motion the pedal control structure.

In one embodiment, the pedal control structure, such as pedal control structure 105 of FIG. 1, can include handle bar 201 and foot pedal 107 affixed to pedal bracket 205. Handle bar 201 may be configured to allow hand rests for a user exerting force (e.g. via foot pedaling or stepping) to drive rocking motion of the rocker frame via foot pedal 107. Handle bar 201 may include multiple sections to extend vertically with an adjustable height from foot pedal 107.

Figure 3:
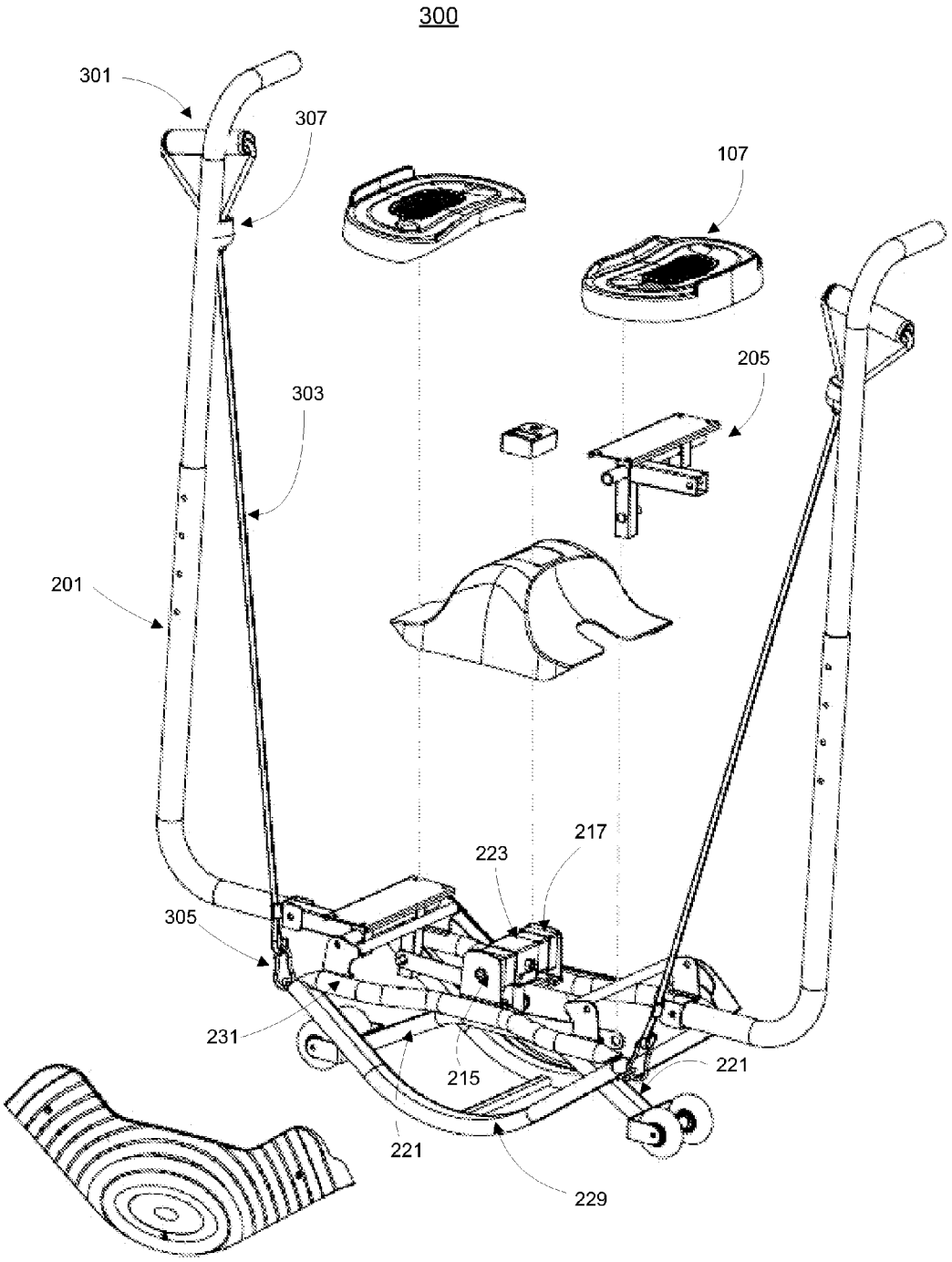
FIG. 3 is an exploded view of an alternative embodiment of an exercise machine.

FIG. 3 is an exploded view of an alternative embodiment of an exercise machine. Device 300 may be based on an exercise machine as shown in, for example, FIG. 1. In one embodiment, the pedal control structure, such as pedal control structure 105 of FIG. 1, may include guide 307 defined on handle bar 201, hook 305 defined on a distal end of arcuate rail 229 and handle cord 303 coupled between hook 305 and guide 307. Device 300 may include a pair of handle cords 303 on the left and right side of the rocker frame. Handler 301 may be attached on a top end of handle cord 303 opposite of coupled hook 305. Handler 301 may be configured to allow a user to pull handle cord 303 through guide 307 to assist the user exerting the driving force for the rocking motion of the rocker frame (e.g. to improve upper body strength conditioning).

Figure 4A:
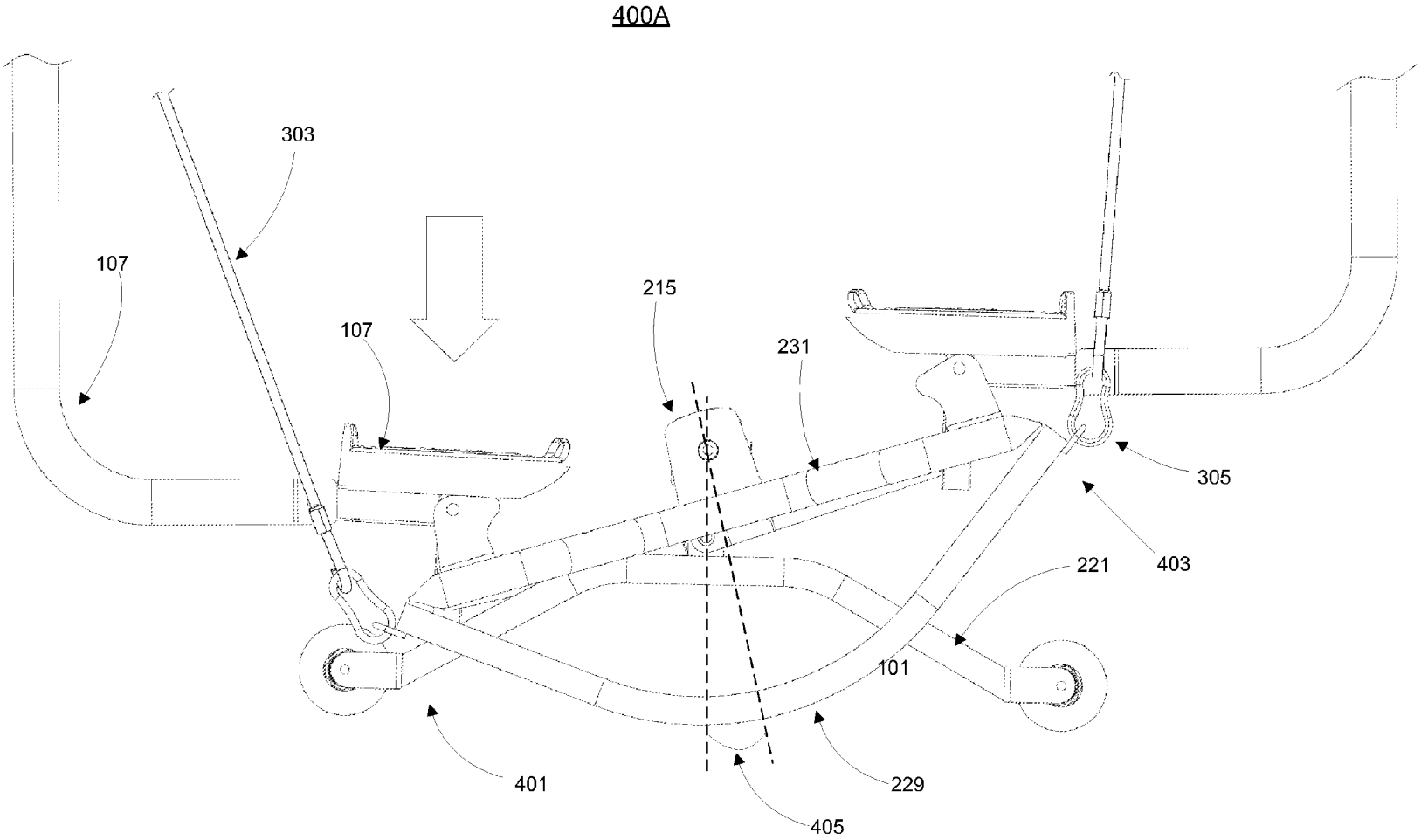
FIGS. 4A-4B show examples of an application of an exercise machine according to one embodiment of the present invention.
Figure 4B:
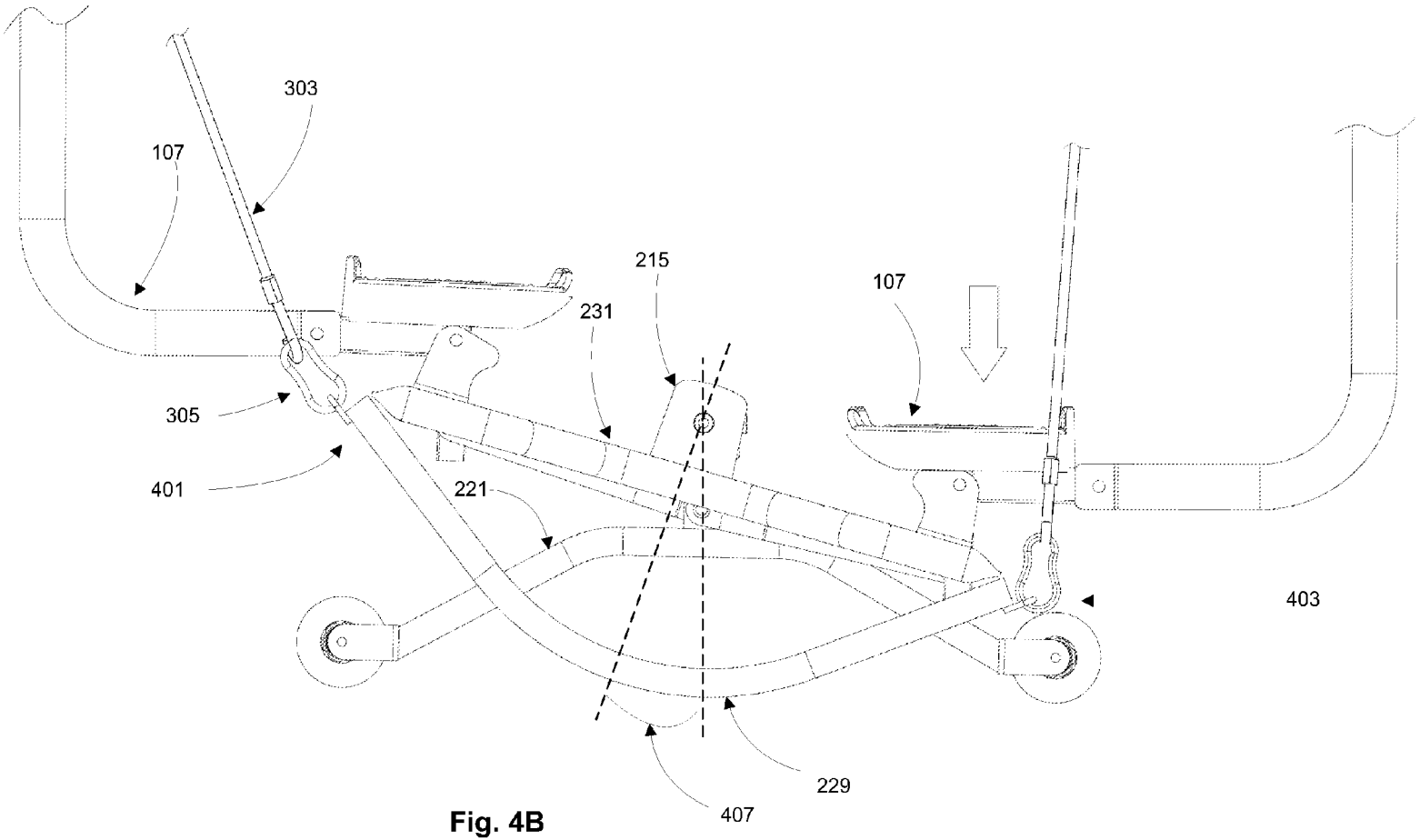

FIGS. 4A-4B show examples of an application of an exercise machine according to one embodiment of the present invention based on, for example, device 100 of FIG. 1. Turning now to FIG. 4A, a user can step on his/her left foot on foot pedal 107 to cause the rocker frame to rock towards the left side 403. The rocking motion may push the roller assembly including leg structure 221 to roll towards the right side 401. The rolling motion of the roller assembly and the rocking motion of the rocker can cause a torque force via a torsion resistance mechanism enclosed via holder 215 to counter the rocking motion and the rolling motion to resist the force exerted by the user. Twisting angle 405 may be formed between the roller assembly and the rocker around the axis of the torsion resistance mechanism to generate the torque force.

Alternatively, turning now to FIG. 4B, the user can step on his/her right foot on foot pedal 107 to cause the rocker frame to rock towards the right side 401. The rocking motion may push the roller assembly to roll towards the left side 403 and cause a torque force to counter the force exerted by the user. The resistance provided by the torsion resistance mechanism can allow the user to perform left to right (or right to left) stepping or rocking movements in an effective exercise. The resistance may correspond to a torque force proportional to twisting angle 407 and a torsion constant of the resistance mechanism.

Many modifications and other embodiments of the invention set forth herein will come to mind to one skilled in the art to which the invention pertains to having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercising device comprising:

a rocker frame having at least one arcuate rail to provide floor support for a rocking motion;

at least one pedal control structure pivotally coupled with the rocker frame near each distal end of the arcuate rail, the pedal control structure to drive the rocking motion; and a roller assembly movably coupled with the rocker frame via a torsion resistance mechanism, the roller assembly confined to a rolling motion on a floor via the rocking motion of the rocker frame, wherein changes in relative positions between the rocker frame and the roller assembly via the rocking motion and the rolling motion cause a torque force in the torsion resistance mechanism, the torque force to counter a force driving the rocking motion to support exercising movements of a user exerting the force, and wherein the torsion resistance mechanism comprises a torsion bar affixed transversely with the roller assembly and the rocker frame, the torsion bar to generate the torque force when deformed by the changes in the relative position between the roller assembly and the rocker frame.

2. The exercising device of claim 1, wherein the roller assembly comprises:

a leg structure having two ends extending longitudinally towards two distal ends of the rocker frame, the leg structure having a mid portion between the two ends; and one or more rolling members rotatably attached to each end of the leg structure to support the rolling motion, wherein the rocker frame is rotatably coupled with the mid portion of the leg structure to confine the rolling motion of the roller assembly via the rolling members.

3. The exercising device of claim 2, wherein the rocker frame includes a pair of arcuate rails configured substantially parallel to each other, and wherein the leg structure is arranged in between the pair of arcuate rails.

4. The exercising device of claim 2, wherein the torsion bar is fixedly engaged with the rocker frame and the roller assembly at separate engaging positions longitudinally along the torsion bar, wherein the torsion bar is deformed between the engaging positions to generate the torque force.

5. The exercising device of claim 4, wherein the resistance mechanism includes a torsion sleeve affixed to the mid portion of the leg structure, wherein the torsion bar is arranged fittingly through the torsion sleeve to engage with the roller assembly at one of the separate engaging positions between two distal ends of the torsion bar.

6. The exercising device of claim 5, wherein a cross section of the torsion bar is shaped angularly to restrict the torsion bar from rotational movement within the torsion sleeve.

7. The exercising device of claim 6, wherein the cross section of the torsion bar is shaped in a rectangular form.

8. The exercising device of claim 5, wherein the resistance mechanism includes two holder structures, wherein the two distal ends of the torsion bar are separately held fittingly within the holder structures for two of the separate engaging positions.

9. The exercising device of claim 8, wherein the rocker frame includes two bridge members, each bridge member affixed between two distal ends of one of the arcuate rails, and wherein each holder structure is fixedly attached to one of the bridge members.

10. The exercising device of claim 1, wherein the pedal control structure comprises:

a handle bar; and a foot pedal, wherein the handle bar is configured to extend vertically from the foot pedal to allow hand rests for the user exerting force via the foot pedal.

11. The exercising device of claim 10, further comprising:

at least one guide defined on the handle bar;

at least one hook defined in each distal end of the arcuate rail; and a handle cord coupled between the hook and the guide, the handle cord attached with a handle to allow the user to pull the handle cord through the guide to assist the user exerting force.

* * * * *